US009133532B2

(12) United States Patent
Park et al.

(10) Patent No.: US 9,133,532 B2
(45) Date of Patent: Sep. 15, 2015

(54) HIGH-CARBON HOT-ROLLED STEEL SHEET, HIGH-CARBON COLD-ROLLED STEEL SHEET, AND METHOD OF MANUFACTURING THE SAME

(75) Inventors: Kyong-Su Park, Pohang-shi (KR); Han-Chul Shin, Pohang-shi (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 13/824,154

(22) PCT Filed: Sep. 15, 2011

(86) PCT No.: PCT/KR2011/006812

§ 371 (c)(1), (2), (4) Date: Mar. 15, 2013

(87) PCT Pub. No.: WO2012/036483

PCT Pub. Date: Mar. 22, 2012

(65) Prior Publication Data

US 2013/0180631 A1 Jul. 18, 2013

(30) Foreign Application Priority Data

Sep. 16, 2010 (KR) ..... 10-2010-0091086

(51) Int. Cl.

| | |
|---|---|
| ***C21D 8/02*** | (2006.01) |
| ***C22C 38/04*** | (2006.01) |
| ***C22C 38/18*** | (2006.01) |
| ***C21D 9/46*** | (2006.01) |
| ***C22C 38/02*** | (2006.01) |

(Continued)

(52) U.S. Cl.

CPC ..... *C21D 8/0263* (2013.01); *C21D 8/02* (2013.01); *C21D 8/0226* (2013.01); *C21D 9/46* (2013.01); *C22C 38/002* (2013.01); *C22C 38/02* (2013.01); *C22C 38/04* (2013.01); *C22C 38/06* (2013.01); *C22C 38/18* (2013.01); *C21D 2211/001* (2013.01)

(58) Field of Classification Search

USPC ..... 148/333, 602, 603

See application file for complete search history.

(56) References Cited

U.S. PATENT DOCUMENTS 3,981,752 A * 9/1976 Kranenberg et al. ..... 148/504

FOREIGN PATENT DOCUMENTS

| | | | | |
|---|---|---|---|---|
| JP | 5728726 A | | 2/1982 | |
| JP | 10204543 A | * | 8/1998 | ..... C21D 9/48 |
| JP | 2000273537 A | | 10/2000 | |

(Continued)

*Primary Examiner* — Kaj K Olsen
*Assistant Examiner* — Alexander Polyansky
(74) *Attorney, Agent, or Firm* — The Webb Law Firm

(57) ABSTRACT

Provided is a method of manufacturing a high-carbon hot-rolled steel sheet, including the steps of i) preparing high-carbon steel materials comprising C: 0.7 to 0.9%, Si: 0.5% or less, Mn: 0.1 to 1.5%, Cr: 0.5% or less, P: 0.05% or less, and S: 0.03% or less in wt % and remaining Fe and other inevitable impurities; ii) heating the high-carbon steel materials again and manufacturing a steel sheet by performing hot rolling in an austenite region in which a finishing temperature for the hot rolling is an Ar3 transformation temperature or higher; iii) rapidly cooling the steel sheet at 520 to 620° C. before phase transformation is started in a Run-Out Table (ROT); iv) uniformly maintaining a cooling retention temperature so that the cooled steel sheet is subject to phase transformation in any one temperature between 520 to 620° C.; and v) winding the steel sheet in the cooling retention temperature. Also provided is the high-carbon steel sheet made by the above-described method.

11 Claims, 6 Drawing Sheets

(51) Int. Cl.
*C22C 38/00* (2006.01)
*C22C 38/06* (2006.01)

(56) References Cited

FOREIGN PATENT DOCUMENTS

| | | | |
|---|---|---|---|
| JP | 2001200316 | A | 7/2001 |
| JP | 2004137527 | A | 5/2004 |
| KR | 101998050632 | A | 9/1998 |
| KR | 1020010060650 | A | 7/2001 |
| KR | 1020060043099 | A | 5/2006 |
| KR | 1020080107196 | A | 12/2008 |
| KR | 1020100021273 | A | 2/2010 |
| KR | 1020100074828 | A | 7/2010 |
| WO | 2010018920 | A2 | 2/2010 |
| WO | 2010074463 | A3 | 7/2010 |

* cited by examiner

HIGH-CARBON HOT-ROLLED STEEL SHEET, HIGH-CARBON COLD-ROLLED STEEL SHEET, AND METHOD OF MANUFACTURING THE SAME

TECHNICAL FIELD

The present invention relates to a high-carbon steel sheet and a method of manufacturing the same. More particularly, the present invention relates to a subsequent process omission-type high-carbon hot-rolled steel sheet capable of satisfying quality of the final product even without some of processes subsequent to hot rolling and a method of manufacturing the same.

BACKGROUND ART

A high-carbon steel sheet refers to a steel sheet that contains carbon of 0.3 wt % or more and has a crystalline structure having a pearlite crystal phase.

The high-carbon steel sheet is made have high stiffness and high hardness after experiencing the final process. Since the high-carbon steel sheet has high stiffness and high hardness as described above, the high-carbon steel sheet is used as tool steel, spring steel, or mechanical structure steel that requires high stiffness and hardness.

A method of manufacturing high-carbon steel for a spring is described below.

In order to manufacture high-carbon steel for a spring, first, high-carbon steel materials are manufactured and hot rolling, pickling and oiling line, and spheroidizing annealing processes are then performed. Next, after repeating primary cold rolling, heat treatment, and pickling and oiling line processes, the high-carbon steel for a spring is manufactured after a secondary cold-rolled process.

The reason why the pickling and oiling line process is performed after the hot rolling process is to remove an oxide layer inevitably generated in initial materials manufactured by the hot rolling process. Furthermore, the reason why the spheroidizing annealing process is performed is to homogenize a non-uniform structure of the materials resulting from the hot rolling process and also lower the stiffness of the materials so that the primary cold-rolled process is possible.

Furthermore, the primary cold rolling is previously performed in order to optimize the reduction ratio of the secondary cold-rolled process. Furthermore, the heat treatment process performed after the primary cold-rolled process is a process of determining the microstructure of the final product and is performed under proper heat treatment conditions in order to obtain desired quality.

After the heat treatment process, a pickling and oiling line process is performed again in order to remove an additional oxide layer generated in a surface of the steel materials and the final product having a desired thickness is manufactured through the secondary cold-rolled process.

The above-described method of manufacturing a high-carbon steel sheet for a spring, however, is problematic in that very high costs and a lot of time are necessary due to a cost for each process and delivery between the processes because a variety of processes have to be performed even after the hot rolling process.

The above information disclosed in this Background section is only for enhancement of understanding of the background of the invention and therefore it may contain information that does not form the prior art that is already known in this country to a person of ordinary skill in the art.

The present invention has been made in an effort to provide a high-carbon hot-rolled steel sheet and a high-carbon cold-rolled steel sheet having an advantage of both high stiffness and high hardness by forming a fine and uniform fine pearlite structure and a method of manufacturing the same. Another embodiment of the present invention provides a method of manufacturing a high-carbon hot-rolled steel sheet from which a subsequent heat treatment process can be omitted by forming fine pearlite in a hot rolling process.

SUMMARY OF THE INVENTION

An exemplary embodiment of the present invention provides a method of manufacturing a high-carbon hot-rolled steel sheet, including the steps of i) preparing high-carbon steel materials comprising C: 0.7 to 0.9%, Si: 0.5% or less, Mn: 0.1 to 1.5%, Cr: 0.5% or less, P: 0.05% or less, and S: 0.03% or less in wt % and remaining Fe and other inevitable impurities; ii) heating the high-carbon steel materials again and manufacturing a steel sheet by performing hot rolling in an austenite region in which a finishing temperature for the hot rolling is an Ar3 transformation temperature or higher; iii) rapidly cooling the steel sheet at 520 to 620° C. before phase transformation is started in a run-out table (ROT); iv) uniformly maintaining a cooling retention temperature so that the cooled steel sheet is subject to phase transformation in any one temperature between 520 to 620° C.; and v) winding the steel sheet in the cooling retention temperature.

In the cooling step of the method of manufacturing a high-carbon hot-rolled steel sheet, the steel sheet preferably has a phase transformation fraction of 10% or less during the cooling and the steel sheet preferably remains uniform in a range of ±20° C. of the cooling retention temperature. A more preferable range of the cooling retention temperature is ±5° C.

Furthermore, in the step of winding the steel sheet, the steel sheet preferably is wound when a phase transformation fraction is 70% or more.

Furthermore, in the step of uniformly maintaining the cooling retention temperature, the upper part of the steel sheet passing through the ROT preferably is cooled by air and a lower part of the steel sheet passing through the ROT preferably is cooled by water.

Furthermore, in the step of performing hot rolling, the steel sheet is subject to hot rolling in a thickness of 1.4 mm to 4.0 mm.

Furthermore, in the step of rapidly cooling the steel sheet, cooling speed of the steel sheet is 50 to 300° C./sec.

Furthermore, in the step of uniformly maintaining a cooling retention temperature, the steel sheet is maintained for 5 seconds to 60 seconds.

Another exemplary embodiment of the present invention provides a method of manufacturing a high-carbon hot-rolled steel sheet from which one or more processes, selected from a pickling and oiling line process, a spheroidizing annealing process, and a primary cold-rolled process on the wound steel sheet, are omitted.

Yet another exemplary embodiment of the present invention provides a method of manufacturing a high-carbon hot-rolled steel sheet, further including a step of performing cold rolling on the wound steel sheet at a reduction ratio of 70% or more by omitting a heat treatment process.

Still another exemplary embodiment of the present invention provides a high-carbon hot-rolled steel sheet, including high-carbon steel materials including C: 0.7 to 0.9%, Si: 0.5% or less, Mn: 0.1 to 1.5%, Cr: 0.5% or less, P: 0.05% or less, and S: 0.03% or less in wt %, remaining Fe, and other inevitable impurities, wherein a microstructure of the steel materials comprises a fine pearlite phase having a lamellar structure in which an interlayer interval between stratified carbide layers is 50 to 200 nm.

Here, the interlayer interval between the stratified carbide layers of the fine pearlite phase preferably has a uniform size within ±20 nm.

Furthermore, an average colony size or particle size of the fine pearlite phase preferably is 1 to 5 μm.

Furthermore, the fine pearlite phase preferably has a volumetric fraction of 70% or more. More preferably, the sum of volumetric fractions of the fine pearlite phase and a bainite phase preferably is 90% or more.

Furthermore, the hot-rolled steel sheet has Vickers hardness of 300 to 400 HV.

Further yet another exemplary embodiment of the present invention provides a high-carbon cold-rolled steel sheet obtained by performing cold rolling the above-described high-carbon hot-rolled steel sheet.

Advantageous Effects

The method of manufacturing the high-carbon hot-rolled steel sheet in accordance with an exemplary embodiment of the present invention has a technical advantage in that transformation heat occurring during phase transformation in a hot rolling process on high-carbon steel can be effectively controlled by way of the weak cold pattern of upper air cooling and lower water cooling.

There is an advantage in that uniform and fine pearlite can be manufactured in a hot rolling process by effectively controlling the generation of transformation heat as described above.

Furthermore, quality of a product can be improved because a defective shape or local overcooling resulting from upper cooling can be prevented by controlling the cold pattern in the hot rolling process.

The high-carbon hot-rolled steel sheet manufactured in accordance with an exemplary embodiment of the present invention has a technical advantage in that it can provide an excellent high-carbon hot-rolled steel sheet having both high stiffness and high hardness because fine pearlite having an interlayer interval of 50 nm to 200 nm can be manufactured.

An exemplary embodiment of the present invention has a technical advantage in that a heat treatment process, from among subsequent manufacturing processes, can be omitted because a high-carbon hot-rolled steel sheet including fine pearlite having an interlayer interval of 50 nm to 200 nm can be fabricated.

Furthermore, there is a technical advantage in that a subsequent pickling and oiling line process, a subsequent spheroidizing annealing, and primary cold rolling can be omitted in addition to a heat treatment process after hot rolling.

Furthermore, a cost for subsequent processes and the time taken for a manufacturing process can be reduced because the subsequent processes can be omitted as described above.

In addition, there is a technical advantage in that environmental pollution occurring in a pickling and oiling line process and a heat treatment process can be prevented.

DETAILED DESCRIPTION OF THE INVENTION

Figure 1:
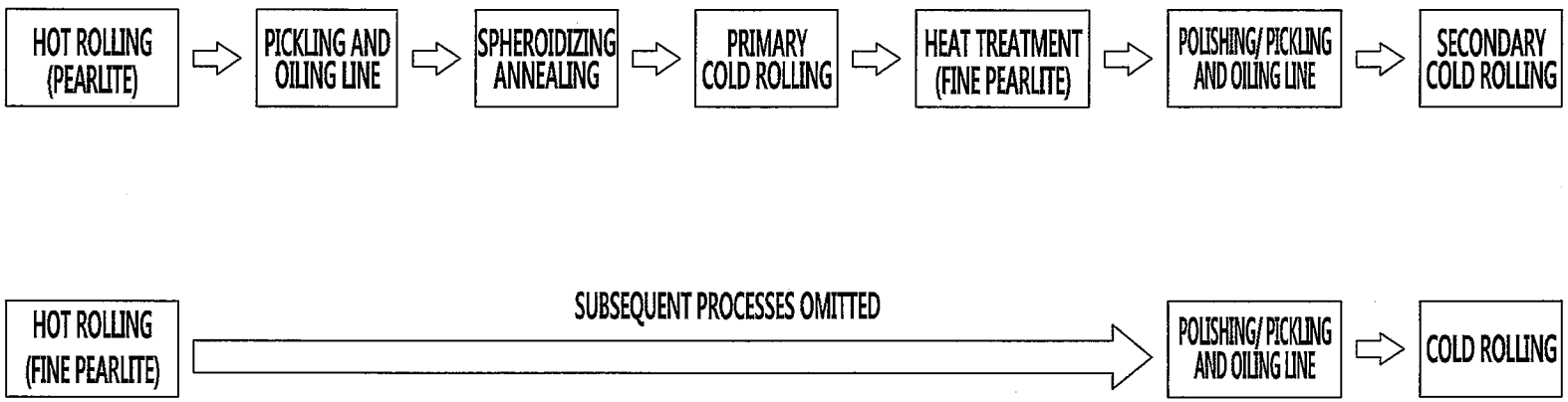
FIG. 1 is a comparison process diagram showing a process of manufacturing a high-carbon hot-rolled steel sheet in accordance with an exemplary embodiment of the present invention and a conventional manufacturing process.

Technical terms used in this specification are intended to describe only specific exemplary embodiments and are not intended to restrict the present invention. The singular form used in this specification includes the plural forms unless specially described otherwise in sentences. Furthermore, a term, such as 'comprise' or 'include' used in the specification, materializes a specific characteristic, area, integer, step, operation, element and/or component and does not exclude the existence or addition of another specific characteristic, area, integer, step, operation, element, component and/or group.

Although not defined otherwise, all terms including technical terms and scientific terms used in this specification have the same meanings as those commonly understood by a person having ordinary skill in the art to which the present invention pertains. Terms defined in a common dictionary are construed as having meanings that comply with related technical documents and disclosed contents and are not construed as being ideal or very official meanings unless defined otherwise.

Furthermore, an expression of the chemical composition of a component element in the present invention means wt % unless defined otherwise.

Exemplary embodiments of the present invention are described in detail below. The exemplary embodiments are intended to merely illustrate the present invention, and the present invention is not limited thereto.

A high-carbon hot-rolled steel sheet in accordance with an exemplary embodiment of the present invention includes C: 0.7 to 0.9%, Si: 0.5% or less, Mn: 0.1 to 1.5%, Cr: 0.5% or less, P: 0.05% or less, and S: 0.03% or less in wt %, iron (Fe), and other inevitable impurities.

The reason why the chemical composition of the high-carbon hot-rolled steel sheet is limited as described above is described below.

First, carbon (C) is described. Carbon (C) is a component that determines a faction of a high-carbon steel microstructure. If carbon (C) of 0.7% or less is included in the high-carbon steel microstructure, the stiffness of the microstructure is lowered because a ferrite structure is created or the carbide layer of pearlite becomes thin in a hot rolling process. In contrast, if carbon (C) exceeds 0.9%, the stiffness of a microstructure is excessively increased because free cementite is formed or the carbide layer of pearlite becomes too thick in a hot rolling process. In this case, there is a problem in that a cold rolling property is deteriorated or the durability of the final product is lowered. For this reason, carbon (C) preferably includes a range of 0.7 to 0.9%.

Silicon (Si) is described below. Silicon (Si) functions as a deoxidizer and functions to improve stiffness. As content of silicon (Si) is increased, however, stiffness may be increased, but surface quality of a product can be deteriorated because scales are formed in a surface of a steel sheet in a hot rolling process or subsequent manufacturing processes. For this reason, silicon (Si) preferably includes 0.5% or less.

Manganese (Mn) is described below. Manganese (Mn) can improve hardenability and stiffness and can suppress the generation of a crack due to sulfur (S) by generating MnS in combination with sulfur (S). Accordingly, in order to form MnS, it is necessary to include manganese (Mn) of 0.1% or more. If manganese (Mn) of 1.5% or more is included, however, tenacity is deteriorated or phase transformation is delayed unnecessarily. Accordingly, manganese (Mn) preferably includes a range of 0.1 to 1.5%.

Chromium (Cr) is described below. Chromium (Cr) functions to improve stiffness, suppress decarbonizing, and improve hardenability. If chromium (Cr) of 0.5% or more is included, however, there is a problem in that hardenability is increased. Accordingly, chromium (Cr) preferably includes 0.5% or less.

Next, phosphorous (P) is described. If a percentage of phosphorous (P) exceeds 0.05%, tenacity is deteriorated because segregation occurs in a grain boundary. Accordingly, content of phosphorous (P) preferably is controlled 0.05% or less.

Next, sulfur (S) is described. If content of sulfur (S) exceeds 0.03%, there is a problem in that steel is brominated because sulfur (S) is precipitated in a manufacturing process. Accordingly, content of sulfur (S) preferably is controlled 0.03% or less.

The high-carbon hot-rolled steel sheet in accordance with an exemplary embodiment of the present invention includes iron (Fe) and other inevitable impurities in addition to the above-described elements.

A method of manufacturing the above-described high-carbon hot-rolled steel sheet is described below.

First, high-carbon steel materials (e.g., a slab form) including C: 0.7 to 0.9%, Si: 0.5% or less, Mn: 0.1 to 1.5%, Cr: 0.5% or less, P: 0.05% or less, and S: 0.03% or less in wt %, Fe, and other inevitable impurities are manufactured.

Next, the manufactured steel materials are heated again and then subject to hot rolling. The hot rolling preferably is performed in an austenite region in which finishing temperature is Ar3 transformation temperature or higher. The reason why the finishing temperature of the hot rolling is set as described above is as follows.

If the finishing temperature for the hot rolling is Ar3 transformation temperature or lower, free ferrite or free cementite is formed, thereby deteriorating the stiffness or durability of the final structure.

A thin plate having a thickness of 1.4 mm or more to 4.0 mm or less is manufactured by performing the hot rolling on the steel materials under the above conditions. The reason why the thickness of the hot-rolled steel sheet is limited as described above is as follows. If the thickness of the thin plate exceeds 4.0 mm, a phase transformation rate cannot be secured prior to winding because a sufficient amount of cooling cannot be secured in subsequent cooling and temperature retention processes and a uniform structure cannot be obtained because a temperature deviation in a thickness direction is increased when lower cooling is performed in the temperature retention process. In contrast, if the thickness of the hot-rolled steel sheet is less than 1.4 mm, rolling is not performed well due to an increased hot rolling load. Furthermore, if the final product is manufactured after hot rolling, the amount of cold rolling processing is reduced because a reduction of the thickness by way of cold rolling is reduced, thereby lowering the stiffness of the final product.

Next, the thin plate preferably is rapidly chilled by way of control cooling in run-out table (ROT) in a temperature of 520° C. or more to 620° C. or less prior to the start of phase transformation. At this time, cooling speed preferably is 50 to 300° C/sec. The reason why the thin plate is chilled in this temperature range is as follows.

If the cooling temperature of the thin plate is less than 520° C., transformation into the fine pearlite is not performed, but a large amount is transformed into bainite (refer to a comparative example 1-1 of FIG. 2), thereby deteriorating the durability of the final product. In contrast, if the cooling temperature exceeds 620° C., coarse pearlite is formed (refer to a comparative example 1-2 or a comparative example 1-3 of FIG. 2) and an interlayer interval between stratified carbide layers is increased, thereby deteriorating stiffness.

Furthermore, in this cooling process, it is necessary to control phase transformation during cooling so that the phase transformation does not exceed 10%. This is because phase transformation in the cooling process is generated at a temperature higher than a temperature retention process, with the result that a uniform and fine pearlite structure cannot be obtained.

Next, the chilled thin plate preferably remains uniform in a range of ±20° C. in any one temperature in a cooling temperature section, more preferably, in a range of ±5° C. For example, if the thin plate has been chilled to 580° C. within 520° C. to 620° C., that is, the cooling temperature section, by way the cooling, temperature of the thin plate preferably remains in a range of 560° C. to 600° C., that is, ±20° C. of the temperature 580° C.

In the case of high-carbon steel, temperature of steel materials rises due to transformation heat occurring during phase transformation because a large amount of carbon is included in the steel. If transformation heat is generated while a steel sheet is subject to phase transformation as described above, a uniform structure cannot be obtained because temperature of the steel sheet rises to the contrary during air cooling.

Accordingly, the steel sheet needs to be chilled by water in order to prevent an increase of temperature due to the generation of transformation heat and uniformly maintain temperature of the steel sheet. If both the upper and lower parts of the steel sheet that rapidly moves in hot rolling equipment are chilled by water, however, control of temperature is difficult and cooling speed becomes fast as needed. As a result, the temperature drops to the contrary and the structure may become non-uniform. In order to prevent temperature of the steel sheet from becoming non-uniform as described above, the upper part of the steel sheet moving in the hot rolling equipment preferably is chilled by air cooling and the lower part of the steel sheet is chilled by water cooling.

A temperature retention process of generating uniform phase transformation is performed in order to uniformly maintain the temperature of the chilled steel sheet by cooling the upper part of the chilled steel sheet by air and cooling the lower part of the chilled steel sheet by water as described above so that a rise in temperature of the chilled steel sheet due to transformation heat occurring in the chilled steel sheet is suppressed.

If control cooling is performed as described above, only a temperature rise corresponding to the generation of transformation heat is chilled, with the result that the temperature of the chilled steel sheet can remain in a range of ±20° C. By uniformly maintaining the temperature of the chilled steel sheet in phase transformation as described above, the structure of the steel sheet can be subject to phase transformation into a uniform and fine pearlite structure.

Figure 5:
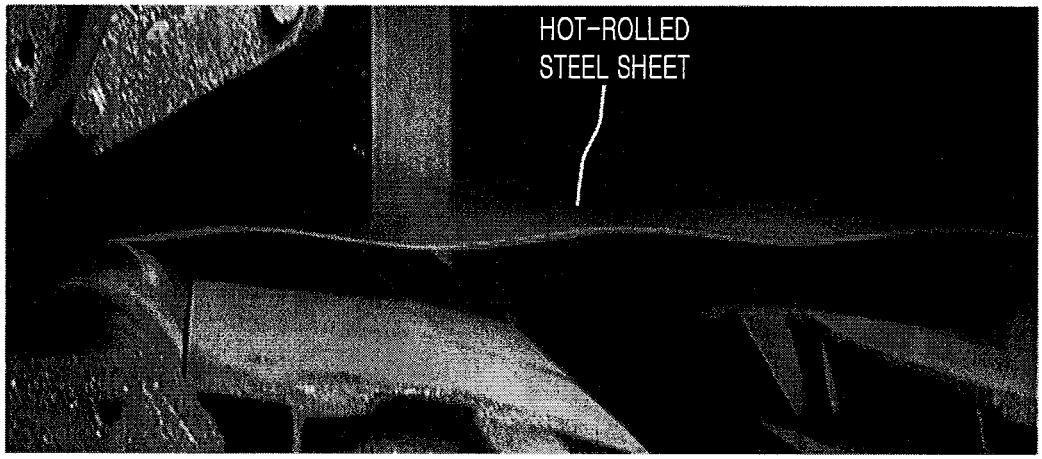
FIG. 5 is a photograph showing a shape of a hot-rolled steel sheet manufactured by cooling upper and lower parts of a steel sheet in accordance with a comparative example of the present invention.

Furthermore, by cooling the upper part of the chilled steel sheet by air, a temperature deviation of the steel sheet in a width direction and the local overcooling of the steel sheet due to stay water resulting from the water cooling can be prevented. Accordingly, a material deviation of the steel sheet can be reduced. Furthermore, a temperature deviation of the steel sheet in a width direction and stay water resulting from the cooling of the upper part may result in a defective shape of the hot-rolled steel sheet. FIG. 5 shows an exemplary defective shape of a hot-rolled steel sheet and shows a winding shape of the hot-rolled steel sheet like a wave when the upper and lower parts of the hot-rolled steel sheet are chilled at the same time. When this defective shape occurs, the workability of subsequent processes can be deteriorated or quality of a product is deteriorated. Accordingly, control using the cooling of the lower part can eventually improve quality of a steel product manufactured using a hot-rolled steel sheet.

After phase transformation is completed while maintaining the thin plate at a regular temperature as described above, the steel sheet is wound in a winder in a coil state. Here, temperature in the winding preferably is the cooling retention temperature of the steel sheet.

Furthermore, a phase transformation fraction of the steel sheet may be 70% or more at a point of time at which the steel sheet is wound. If the phase transformation fraction is less than 70%, transformation heat is generated because phase transformation is generated after the winding and a uniform and fine pearlite structure cannot be obtained because a phase transformation temperature continues to rise. Furthermore, a winding shape is deteriorated due to the temperature rise and the phase transformation. In order to maintain the phase transformation fraction of the steel sheet at 70% or more as described above, it is necessary to control the cooling temperature retention time of the steel sheet 5 seconds or more to 60 seconds or less.

All the above-described processes used to manufacture the hot-rolled steel sheet may be omitted or any one of the above-described processes may be selectively omitted. Subsequent processes that may be omitted include the pickling and oiling line process, the spheroidizing annealing process, the primary cold-rolled process, and the heat treatment process after hot rolling.

In the method of manufacturing the high-carbon steel sheet in accordance with an exemplary embodiment of the present invention, the final cold rolling is immediately performed on the hot-rolled steel sheet manufactured by the above-described processes without the heat treatment process.

Here, the cold rolling of the steel sheet preferably is performed at a reduction ratio of 70% or more. In the cold rolling, a thickness of the final product can be optimized and optimal stiffness and durability can be secured by controlling the reduction ratio according to characteristics necessary for the final product.

In a conventional hot rolling process, a uniform and fine pearlite structure can be obtained through an expensive heat treatment process, that is, a subsequent process, because a uniform and fine pearlite structure cannot be obtained. In the method of manufacturing the high-carbon steel method in accordance with an exemplary embodiment of the present invention, however, subsequent processes and a heat treatment process for forming a fine pearlite structure can be omitted because a uniform and fine pearlite structure can be formed in the hot rolling process.

The cold-rolled steel sheet manufactured as described above is processed into a designed product through a forming processing process and then produced into the final product through deformation aging. The structure of the high-carbon hot-rolled steel sheet on which the subsequent processes have not been performed manufactured by the above-described processes is described below.

The subsequent process omission-type high-carbon hot-rolled steel sheet has a fine pearlite structure including a lamellar structure in which an interlayer interval between stratified carbide layers is 50 nm to 200 nm. If the interlayer interval between the stratified carbide layers exceeds 200 nm, stiffness is lowered because a soft layer between the stratified carbide layers is widened. In contrast, if the interlayer interval between the stratified carbide layers is less than 50 nm, stiffness is excessively increased and durability may be reduced.

A deviation in the interlayer interval between the stratified carbide layers of the fine pearlite preferably is within ±20 run of an average size. The microstructure formed in the hot-rolled steel sheet needs to be uniformly controlled because the hot-rolled steel sheet is used in the final produced without a subsequent heat treatment process. If the interlayer interval between the stratified carbide layers exceeds ±20 nm of an average size, the uniformity of the microstructure is deteriorated and the durability of the final product is not satisfied, with the result that a failure rate may rise.

Furthermore, an average Colony size (i.e., a grain size) of the fine pearlite preferably is 1 μm to 5 μm. If the Colony size is less than 1 μm, a fatigue crack delay effect is deteriorated. In contrast, if the Colony size exceeds 5 μm, a phase transformation fraction prior to winding is not secured because transformation speed is slow.

Figure 3:
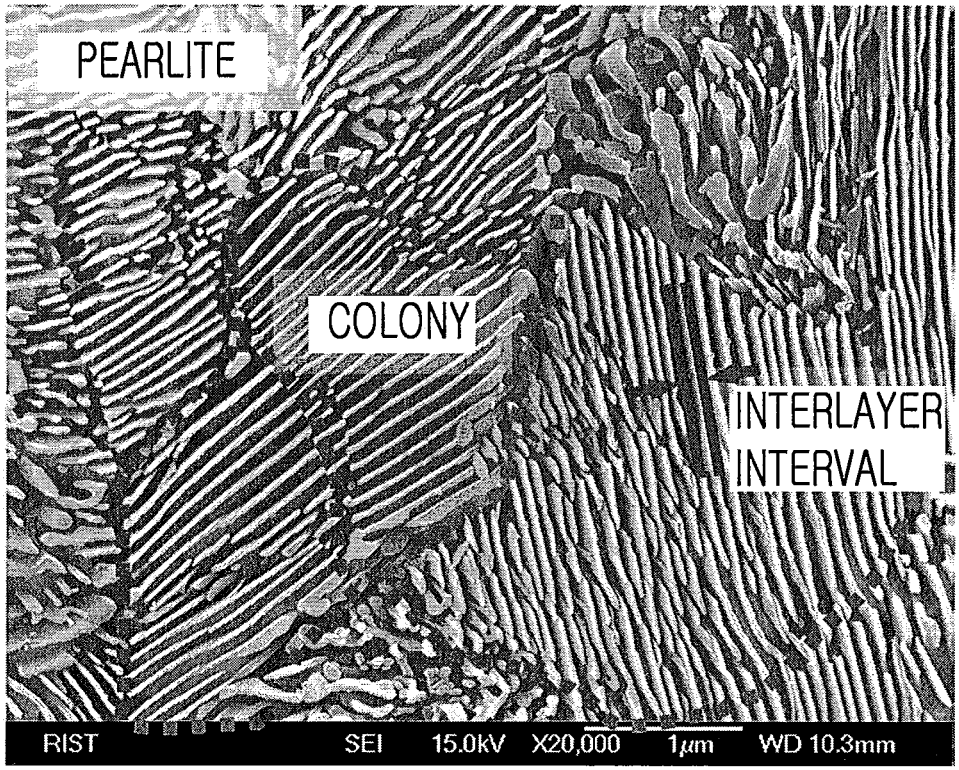
FIG. 3 is an electro microscope photo showing the fine pearlite structure of a manufactured high-carbon hot-rolled steel sheet.

FIG. 3 illustrates the colony of this fine pearlite and an interval between stratified carbide layers.

In the microstructure of the high-carbon hot-rolled steel sheet on which the subsequent processes have not been performed, it is preferred that this fine pearlite phase occupy a volumetric fraction of 70% or more and the sum of the fine pearlite phase and the bainite phase be 90% or more.

In the microstructure, it is preferred that this fine pearlite phase have a volumetric fraction of 70% or more because the fine pearlite phase functions to improve stiffness and durability and the sum of the fine pearlite phase and the bainite phase be 90% or more because the bainite phase functions to maintain high stiffness.

Furthermore, in the microstructure of the high-carbon hot-rolled steel sheet on which the subsequent processes have not been performed, it is preferred that a ferrite phase deteriorating stiffness and a martensite structure deteriorating durability do not exceed 10%.

Furthermore, the high-carbon hot-rolled steel sheet on which the subsequent processes have not been performed preferably has Vickers hardness of 300 HV to 400 HV. The hot-rolled steel sheet having this hardness range can secure an initial stiffness value necessary to obtain stiffness of the final product after subsequent cold rolling.

The present invention is described in more detail below in connection with experimental examples. The experimental examples are provided to only illustrate the present invention, and the present invention is not limited thereto.

EXPERIMENTAL EXAMPLES

Pieces of high-carbon steel having compositions, such as those of Table 1, were prepared in order to examine the microstructure and hardness of the high-carbon hot-rolled steel sheet on which the subsequent processes have not been performed.

TABLE 1

| Type | C (wt %) | Si (wt %) | Mn (wt %) | Cr (wt %) | P (wt %) | S (wt %) |
|---|---|---|---|---|---|---|
| Exemplary embodiment 1 | 0.83 | 0.18 | 0.417 | 0.1 | 0.0176 | 0.004 |
| Comparative examples 2 | 0.57 | 0.19 | 0.501 | 0.1 | 0.0165 | 0.004 |
| Comparative examples 3 | 1.04 | 0.18 | 0.496 | 0.1 | 0.0170 | 0.004 |

After manufacturing slabs having the compositions of Table 1, the slabs were heated again at 1170° C. and then subject to hot rolling, thus manufacturing thin plates.

The pieces of hot-rolled steel sheets on which the hot rolling were performed had a sheet thickness of 2.01 mm both in the comparative examples and the exemplary embodiment.

The thin plates on which the finishing hot rolling was performed as described above were suddenly chilled in a Run-Out Table (ROT) under conditions of Table 2 below. Next, the thin plates were uniformly maintained in respective cooling temperatures having a range of ±5° C. and were then wound in a cooling temperature.

The microstructures and hardness of the thin plates manufactured in different transformation temperatures were measured, and results of the measurement were shown in Table 2 below. The exemplary embodiment 1 of Table 1 corresponds to a comparative example 1-1 to a comparative example 1-4 and an exemplary embodiment 1-1 to an exemplary embodiment 1-3 of Table 2, and the comparative example 2 and the comparative example 3 of Table 1 correspond to a comparative example 2-1 and a comparative example 3-1 in Table 2.

TABLE 2

| Type | Transformation temperature (° C.) | Stratified interval (nm) | Hardness (HV) | Microstructure |
|---|---|---|---|---|
| Comparative example 1-1 | 500 ± 5 | — | 381 | bainite |
| Exemplary embodiment 1-1 | 550 ± 5 | 117 | 328 | fine pearlite |
| Exemplary embodiment 1-2 | 580 ± 5 | 123 | 323 | fine pearlite |
| Exemplary embodiment 1-3 | 600 ± 5 | 125 | 304 | fine pearlite |
| Comparative example 1-2 | 650 ± 5 | 157 | 293 | coarse pearlite |
| Comparative example 1-3 | 700 ± 5 | 346 | 230 | coarse pearlite |
| Comparative example 1-4 | 600-680 | 120-200 | 260-300 | mixed phase |
| Comparative example 2-1 | 580 ± 5 | 219 | 281 | fine pearlite |
| Comparative example 3-1 | 580 ± 5 | 67 | 405 | fine pearlite |

Figure 2:
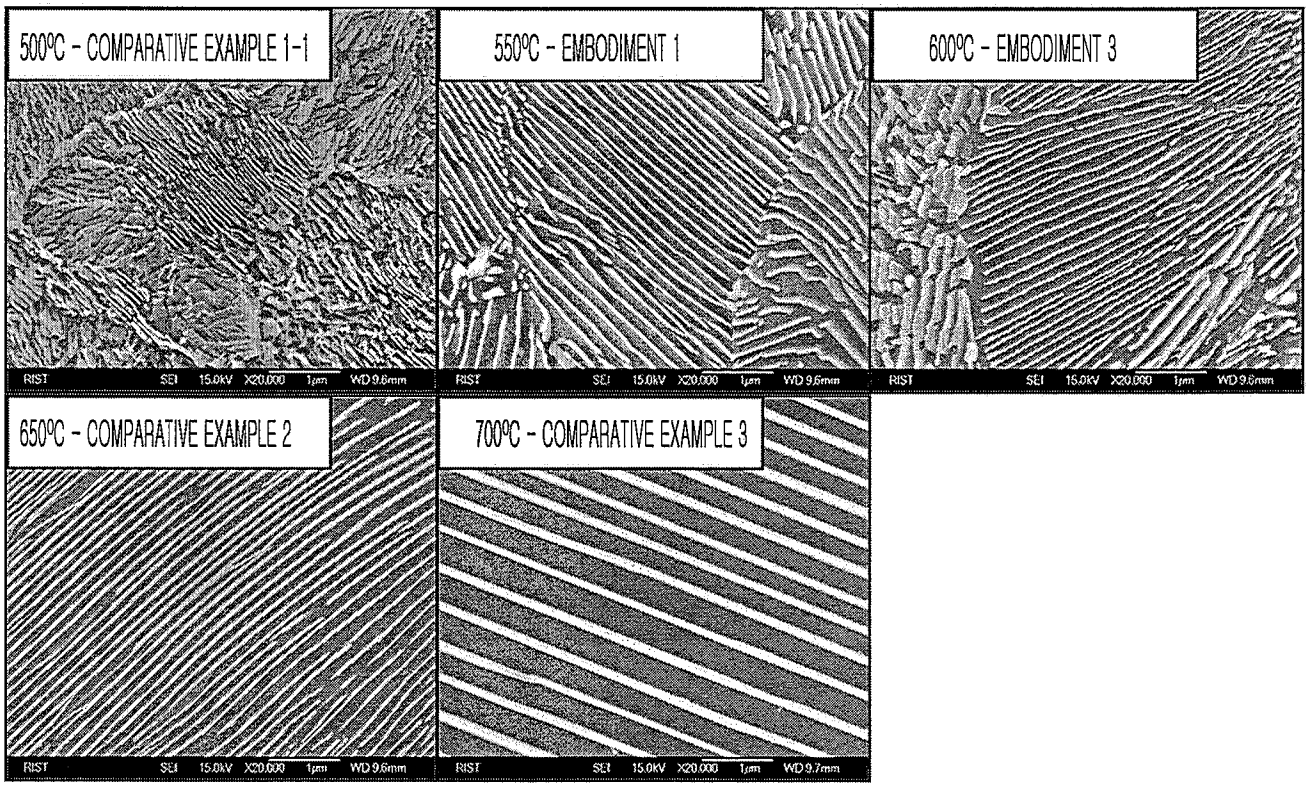
FIG. 2 is an electro microscope photo showing the microstructures of high-carbon hot-rolled steel sheets manufactured in accordance with exemplary embodiments and comparative examples for showing a difference between the microstructures depending on temperature of the present invention.

FIG. 2 shows electron microscope photos of the microstructures of the thin plates manufactured in accordance with the comparative example1-1 to the comparative example 1-3 and the exemplary embodiment 1-1 and the exemplary embodiment 1-3. Furthermore, FIG. 3 shows an electron microscope photo of the microstructure of the thin plate manufactured in accordance with the exemplary embodiment 1-2.

As can be seen from FIGS. 2 and 3, the thin plate of the comparative example 1-1 had a bainite phase because it had a low transformation temperature of 500° C. and the thin plates of the comparative example 1-2 and the comparative example 1-3 had coarse pearlite phases because they had high transformation temperatures of 650° C. and 700° C., respectively. In contrast, the thin plates of the exemplary embodiment 1-1, the exemplary embodiment 1-2, and the exemplary embodiment 1-3 had uniform and fine pearlite phases.

As shown in Table 2, a lamellar gap between stratified carbide layers in pearlite had a rising tendency according to a rise of temperature except the comparative example 1-1 having the bainite phase. Particularly, the thin plate of the comparative example 1-3 had a very great lamellar gap of 346 nm due to the high transformation temperature of 700° C.

Furthermore, as can be seen from Table 2, a Vickers hardness value was in inverse proportion to the transformation temperature. The thin plate of the comparative example 1-1 having the low transformation temperature of 500° C. had a very high Vickers hardness value. This results in that stiffness of the final product is very high and durability of the final product is low after cold rolling.

Figure 6:
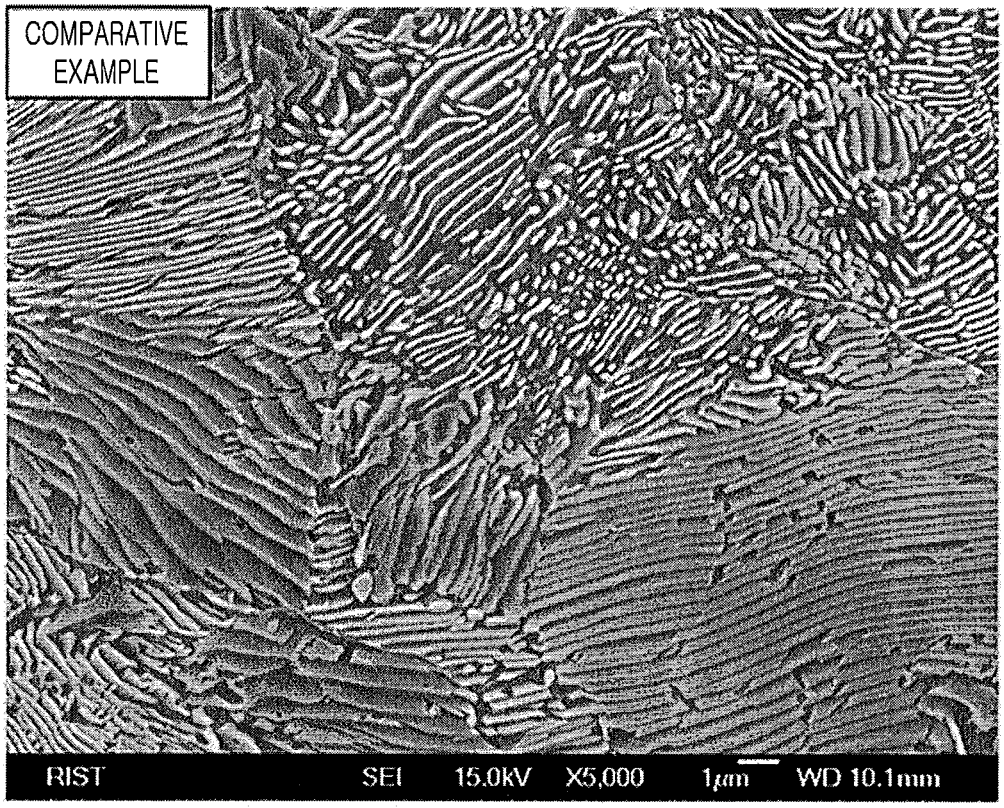
FIG. 6 is an electro microscope photo showing the microstructure of a high-carbon hot-rolled steel sheet manufactured in accordance with a comparative example for checking the uniformity of a microstructure according to the present invention.

Meanwhile, in the case of the thin plate of the comparative example 1-4, the lamellar gap of the microstructure was not uniform (FIG. 6) and a Vickers hardness value was also not uniform because the transformation temperature was controlled between 600° C. to 680° C. without being uniformly maintained. As described above, durability of the final product having a non-uniform structure can be deteriorated because deformation and stress are concentrated on a part having low Vickers hardness.

Furthermore, the thin plates of the comparative example 2-1 and the comparative example 3-1 had slightly low content of carbon of 0.57% and slightly high content of carbon of 1.04%. When the thin plates having the content of carbon were manufactured in the transformation temperature of 580° C., they showed interlayer intervals and Vickers hardness values other than reference values. The thin plate of the comparative example 2-1 having low content of carbon showed a wide interlayer interval between stratified carbide layers and a low Vickers hardness value. The thin plate of the comparative example 3-1 having high content of carbon showed a narrow interlayer interval between stratified carbide layers and a high Vickers hardness value.

Figure 4:
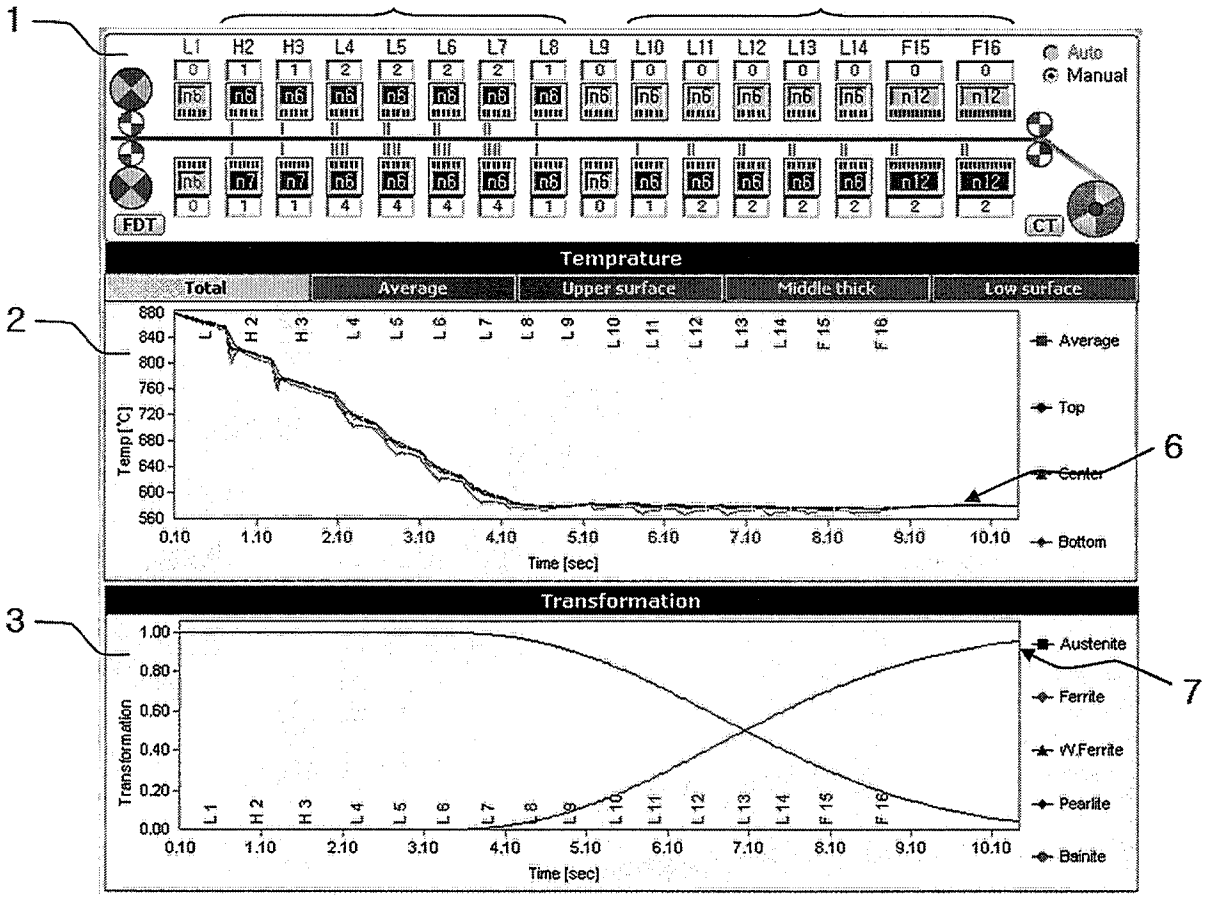
FIG. 4 is an explanatory diagram showing a cooling method in accordance with an exemplary embodiment of the present invention and a change in the temperature and phase fraction of a steel sheet according to the cooling method.

FIG. 4 is an explanatory diagram showing a method of cooling the hot-rolled thin plate and a change of temperature and a change of a phase fraction of the hot-rolled thin plate according to the method with reference to the exemplary embodiment 1-2.

In FIG. 4, reference numeral 1 denotes a control panel that displays a cooling state of a Run-Out Table (ROT). In the control panel 1, a roll figure (FDT) on the left indicates a finishing hot rolling roll and a roll figure (CT) on the right indicates a winding roll. Furthermore, reference numeral 4 indicates the first half of the ROT, which indicates a cooling process for rapidly cooling the thin plate after the finishing hot rolling in the ROT. Furthermore, reference numeral 5 indicates the second half of the ROT, which indicates a temperature retention process for maintaining the chilled temperature of the thin plate after the cooling process without change.

In FIG. 4, cooling water spray banks denoted by L1 to F16 are installed in the ROT in the cooling process 4 and the temperature retention process 5 from the left to the right. Each of the cooling water spray banks includes a plurality of cooling water spray nozzles, and the spray amount of cooling water is controlled by adjusting the number of cooling water spray nozzles and the number of spray banks as needed. In FIG. 4, numbers 0, 1, 2, and 4 indicated right under L1 to F16 and at the bottom line of the control panel 1 indicate numbers of the nozzles that operate in each of the cooling water spray banks.

In the present experimental example, in the cooling process 4, the spray banks are simultaneously driven to spray cooling water in the upper and lower parts of a thin plate (i.e., a line that couples a finishing hot rolling roll and the center of a winding roll together) that passes between rolls. In the temperature retention process 5, cooling water spray banks installed in the upper part of the thin plate are not driven, but only cooling water spray banks installed in the lower part of the thin plate are driven to cool the lower part of the thin plate. The operating condition of the ROT is the same in all the comparative example 1-1 to the comparative example 1-3 and the exemplary embodiment 1-1 to the exemplary embodiment 1-3.

In FIG. 4, reference numeral 2 is described below. Reference numeral 2 indicates a temperature change and a transition time for the high-carbon thin plate in accordance with the exemplary embodiment 1-2 in the ROT. The thin plate of the exemplary embodiment 1-2 is cooled from 880° C. and then stopped at 580° C. in the cooling process 4 of the ROT, and then 580° C.±3 remains intact (6) in the temperature retention process 5.

Reference numeral 3 of FIG. 4 shows a phase change rate according to a lapse of time while the high-carbon thin plate in accordance with the exemplary embodiment 1-2 passes through the ROT as described above. Furthermore, reference numeral 7 of FIG. 4 indicates a phase transformation fraction at a point of time of winding.

A microscope photo of the microstructure of the thin plate in accordance with the exemplary embodiment 1-2 manufactured under experimental conditions, such as those of FIG. 4, is shown in FIG. 3.

As shown in FIG. 3, the thin plate manufactured in accordance with the exemplary embodiment 1-2 had a microstructure including fine pearlite and a lamellar structure in which an interlayer interval between the stratified carbide layers of the microstructure was about 123 nm, and an average colony size of the fine pearlite was about 2 μm.

Next, cold rolling was performed on the fine plates of the comparative example 1-1 and the exemplary embodiment 1-3.

In order to perform the cold rolling, first, an oxide layer on a surface of the manufactured hot-rolled steel sheet was removed by performing a pickling and oiling line on the hot-rolled steel sheet. Next, a cold-rolled steel sheet having a thickness of 0.23 mm was manufactured by performing the cold rolling on the hot-rolled steel sheet at a reduction ratio of 88.5%.

As the results of the cold rolling under the conditions, the hot-rolled steel sheet manufactured in accordance with comparative example 1-1 had a problem in that the steel itself was continuously severed because a crack was generated from the side during the cold rolling and the cold rolling was no longer performed because stiffness was too high at a specific reduction ratio or higher.

In contrast, the hot-rolled steel sheet manufactured under the conditions in accordance with the exemplary embodiment 1-3 was produced into the cold-rolled steel sheet having uniform quality under the above-described cold rolling condition.

Accordingly, the cold-rolled steel sheet manufactured in accordance with the exemplary embodiment 1-3 was formed and processed into a spring. The product processed as described above was subject to strain aging and then manufactured into high-carbon steel for a spring.

It was checked that, as a result of the final product test for the manufactured high-carbon steel for a spring, the high-carbon steel had tensile strength of 2205 MPa and durability of 120,000 times or more.

Accordingly, if hot rolling and cold rolling are performed on a thin plate and the thin plate is formed into spring steel in accordance with an exemplary embodiment of the present invention, it was checked that the spring steel had tensile strength of 2200 MPa or more and durability of 120,000 times or more, that is, requirement criteria of the final spring steel.

If a uniform and fine pearlite structure is formed by way of hot rolling as described above, it was checked that the final product having desired quality could be obtained even without subsequent manufacturing processes, such as heat treatment.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method of manufacturing a high-carbon hot-rolled steel sheet, comprising the steps of:

preparing a high-carbon steel slab comprising C: 0.7 to 0.9%, Si: 0.5% or less, Mn: 0.1 to 1.5%, Cr: 0.5% or less, P: 0.05% or less, and S: 0.03% or less in wt %, with the remainder being Fe and other inevitable impurities;

hot-rolling the high-carbon steel slab in an austenite region on a hot-rolling mill to form a steel sheet, wherein a finishing temperature for the hot rolling is greater than or equal to the Ar3 transformation temperature;

cooling the steel sheet to 520 to 620° C. in a Run-Out Table (ROT) of the hot-rolling mill;

uniformly maintaining a cooling retention temperature between 520 to 620° C. during which the steel sheet undergoes a phase transformation; and winding the steel sheet at the cooling retention temperature, wherein during maintenance of the steel sheet at the cooling retention temperature, an upper part of the steel sheet passing through the run-out table is cooled by air at the same time as a corresponding lower part of the steel sheet passing through the run-out table is cooled by water.

2. The method of claim 1, wherein during cooling, the steel sheet undergoes a phase transformation of 10% or less.

3. The method of claim 2, wherein in the cooling retention temperature is maintained within a temperature range of ±20° C.

4. The method of claim 2, wherein in the cooling retention temperature is maintained within a temperature range of ±5° C.

5. The method of claim 3, wherein during winding, the steel sheet undergoes phase transformation of 70% or more.

6. The method of claim 1, wherein the steel sheet is hot-rolled to a thickness of 1.4 mm to 4.0 mm.

7. The method of claim 1, wherein cooling of the steel sheet is carried out at a cooling rate of 50 to 300° C/sec.

8. The method of claim 1, wherein the steel sheet is maintained at the cooling retention temperature for 5 seconds to 60 seconds.

9. The method of claim 1, wherein one or more processes selected from the group consisting of pickling and oiling, spheroidizing annealing, and primary cold rolling is not performed on the wound steel sheet.

10. The method of claim 1, further comprising a step of cold rolling the steel sheet at a reduction ratio of 70% or more.

11. The method of claim 6, further comprising a step cold rolling the steel sheet at a reduction ratio of 70% or more.

* * * * *